US008251756B2

(12) United States Patent
Matsuoka

(10) Patent No.: US 8,251,756 B2
(45) Date of Patent: Aug. 28, 2012

(54) NUT HOLDING MEANS WITHIN A BUSBAR HOUSING

(75) Inventor: Hiroyuki Matsuoka, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 206 days.

(21) Appl. No.: 12/764,119

(22) Filed: Apr. 21, 2010

(65) Prior Publication Data

US 2010/0273362 A1 Oct. 28, 2010

(30) Foreign Application Priority Data

Apr. 23, 2009 (JP) ..... 2009-105500

(51) Int. Cl.
*H01R 13/42* (2006.01)

(52) U.S. Cl. ..... 439/737

(58) Field of Classification Search ..... 439/737, 439/801; 361/648; 411/103
See application file for complete search history.

(56) References Cited

U.S. PATENT DOCUMENTS 3,888,560 A * 6/1975 Smith et al. ..... 439/586
6,234,850 B1 * 5/2001 Pandit et al. ..... 439/801
6,361,382 B1 * 3/2002 Yamada et al. ..... 439/801

FOREIGN PATENT DOCUMENTS

JP 2006-31962 2/2006

* cited by examiner

*Primary Examiner* — Vanessa Girardi
(74) *Attorney, Agent, or Firm* — Gerald E. Hespos; Michael J. Porco

(57) ABSTRACT

A device connector has a housing to be mounted on a device. Busbars are held in the housing. The housing includes nut holding portions, each of which has two nut holding legs at positions facing a device connecting portion of the corresponding busbar. A space between the nut holding legs is open sideways. Connecting nuts are sandwiched between the nut holding legs from lateral sides. Nut insertion holes are formed in the device connecting portions of the busbars and communicate with threaded holes of the nuts. Protecting walls are formed integrally to the housing and extend between the nut holding legs of the nut holding portion and cover the leading end of the bolt screwed into the nut.

11 Claims, 7 Drawing Sheets

NUT HOLDING MEANS WITHIN A BUSBAR HOUSING

BACKGROUND OF THE INVENTION

1. Field of the Invention

The invention relates to a device connector of the type having a terminal bolted thereto.

2. Description of the Related Art

Japanese Unexamined Patent Publication No. 2006-31962 discloses a device connector for supplying power to an electric part such as a motor accommodated in a metallic case in an electric car or the like. Busbars are held in a housing of the device connector and are connected with device-side terminals in the case.

Nut holding portions are formed at a position of the housing corresponding to device connecting portions of the busbars. Each nut holding portion has two nut holding legs that hold a nut. On the other hand, the busbars held in the housing are formed with nut insertion holes. Bolts are inserted through the device-side terminals and the nut insertion holes and are screwed into threaded holes of the nuts to connect the terminals with the busbars.

The bolt must be tightened with a specified torque to obtain a reliable connection for fastening the terminal to the busbar. This torque is received by the nut holding legs via the nut. However, a space between the nut holding legs is open sideways. Thus, the spacing between the nut holding legs is widened if an excessive torque acts on the bolt and the nut holding legs can break.

The nut holding legs can be thickened between the adjacent device connecting portions to prevent damage. However, an attempt to increase the strength of the respective nut holding legs with a limited arrangement interval of the device connecting portions effectively forms the nut holding holes in a thick holding wall instead of between two independent nut holding legs. This shortens creepage distances between the nuts and the bolts and presents problems in terms of insulation.

The invention was developed in view of the above situation and an object thereof is to provide a device connector capable of increasing the strength of nut holding legs while ensuring a sufficient creepage distance between adjacent device connecting portions.

SUMMARY OF THE INVENTION

The invention relates to a device connector with a housing to be mounted on a device. Busbars are disposed in the housing and each busbar has a device connecting portion to be connected with the device. The connector also has nut holding portions each of which has two nut holding legs. Nuts are sandwiched between the nut holding legs of the nut holding portions from lateral sides. Nut insertion holes are formed in the device connecting portions of the busbars and communicate with threaded holes of the nuts. A protecting wall is formed integrally or unitary to the housing and extends between the nut holding legs of each nut holding portion and at least partly cover the leading end of the bolt screwed into the nut.

The nut holding legs are formed at positions of the housing substantially facing the device connecting portion of the corresponding busbar so that a space between the nut holding legs is open sideways.

The extension of the protecting wall between nut holding legs ensures sufficient strength in a direction that would extend the spacing between the nut holding legs. In addition, the protecting wall surrounds the leading ends nut and the bolt to ensure a long creepage distance between adjacent bolts.

At least three nut holding portions preferably are formed substantially side by side. The nut holding portions at the opposite ends in an arrangement direction of the nut holding portions each preferably have the protecting wall. Thus, the nut holding portions also are supported by the protecting walls and the strengths of the nut holding legs at the ends is increased.

The protecting wall preferably has such a box shape to expose leading ends of the nut holding legs. The box shape ensures a longer a creepage distance between adjacent bolts. On the other hand, the leading ends of the bolts can be seen at the exposed the leading ends of the nut holding legs to ensure a reliable terminal connecting operation.

The nut holding portions preferably are at different heights in a direction perpendicular to the plate surfaces of the busbars for each pair of adjacent busbars. Thus, different heights of the plate surfaces of the adjacent busbars increases the creepage distance between the bolts.

Plate surfaces of adjacent busbars preferably are at different heights.

A dimension of the protecting wall preferably is larger than a projecting distance of the bolt from the nut to which the bolt is attached. Thus, a distal end of the bolt screwed into the nut does not interfere with an inner surface of the protecting wall.

The housing preferably is united with the busbars by insert molding. Accordingly, the strength of the nut holding legs is increased while ensuring a sufficient creepage distance between adjacent bolts.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 4:
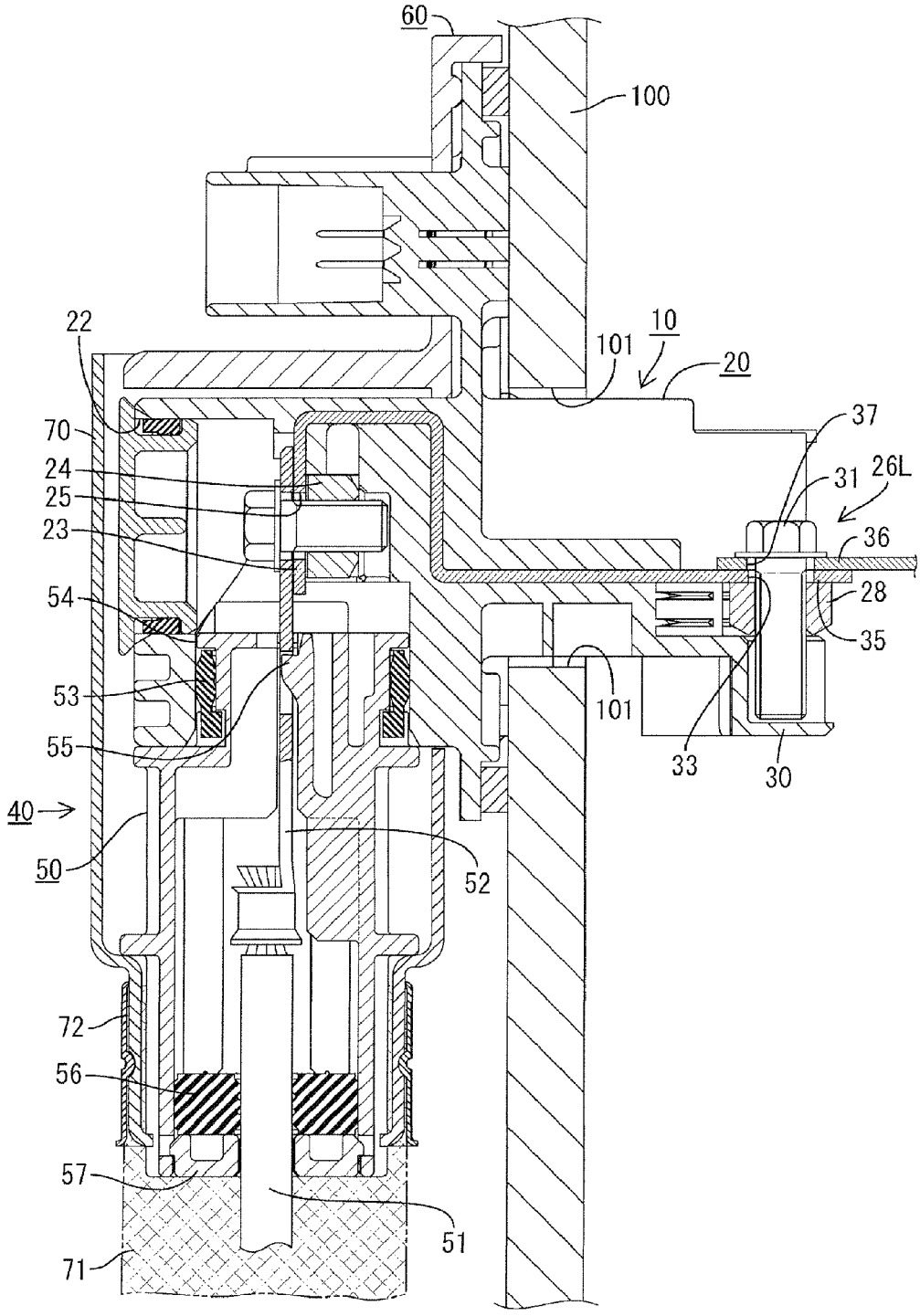
FIG. 4 is a vertical section along IV-IV of FIG. 1 showing a connected state of the device connector.
Figure 5:
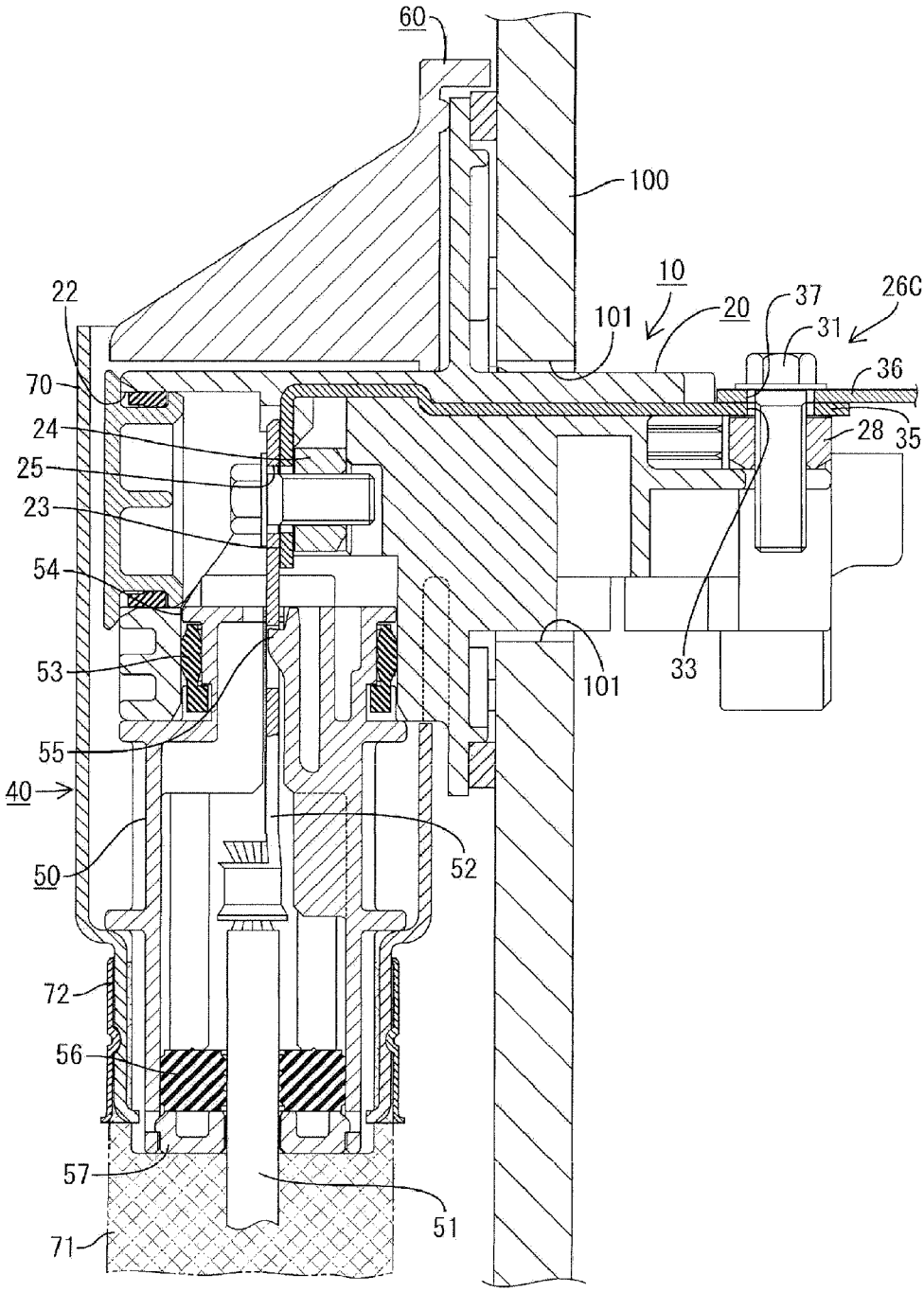
FIG. 5 is a section along V-V of FIG. 1 showing a connected state.
Figure 6:
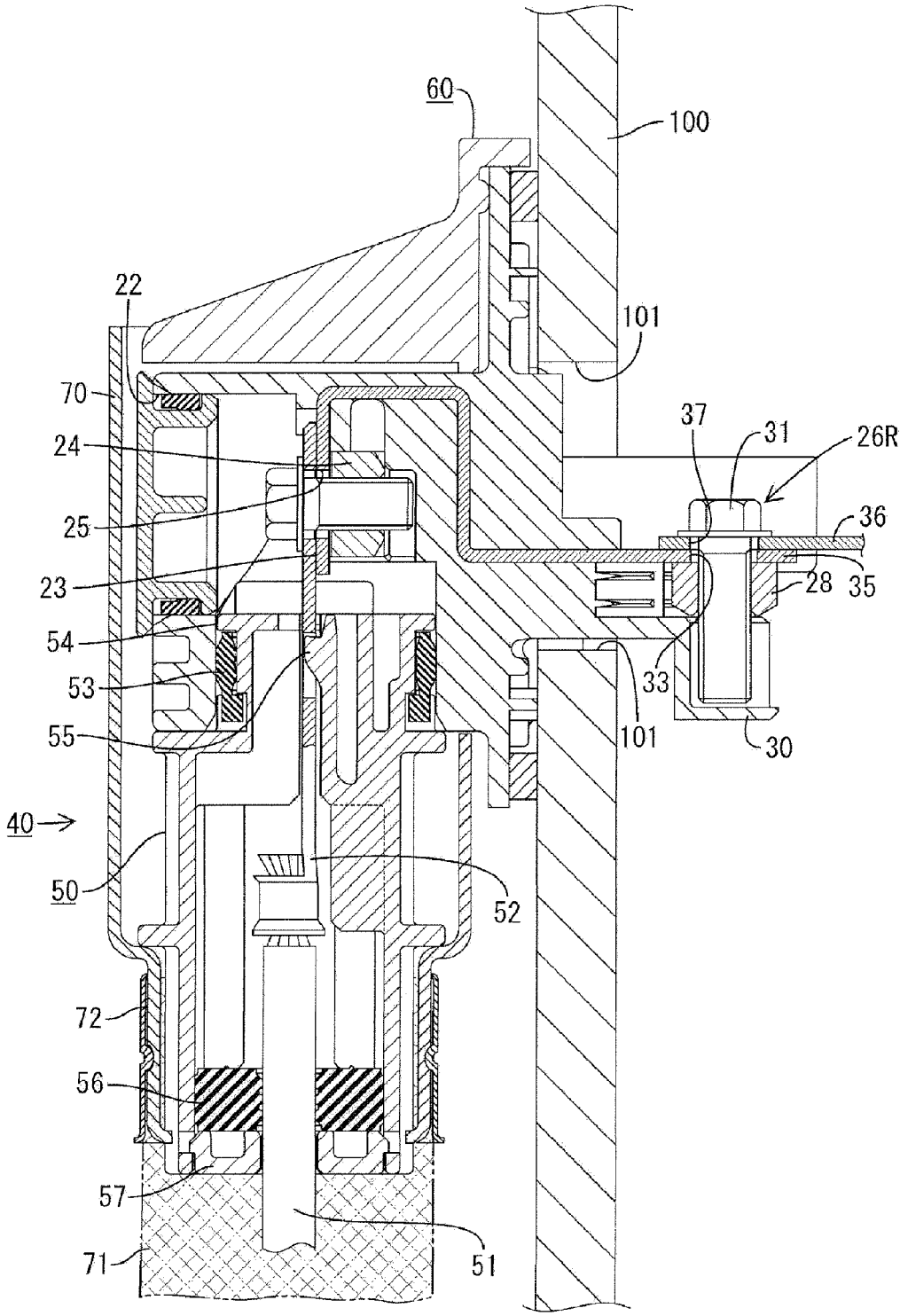
FIG. 6 is a section along VI-VI of FIG. 1 showing the connector connected state.

A device-side connector according to the invention is identified by the numeral 10. The connector 10 is for supplying power to a device, such as a motor or an inverter installed, for example, in a hybrid car or an electric car. More particularly, the connector 10 is mounted on a metallic case 100 of the device via an aluminum die-cast connector mounting plate 60 and has a wire-side connector 40 connected therewith in this mounted state from below, as shown in FIG. 4.

A wire-side housing 50 of the wire-side connector 40 is made e.g. of synthetic resin and three wire-side terminals 52 fixed to ends of respective wires 51 are accommodated inside. A substantially cylindrical fitting 54 with a seal ring 53 is provided at the upper end of the wire-side housing 50. Leading ends of the wire-side terminals 52 are by locking lances 55 and project out from the fitting 54.

The wires 51 are inserted through fluid- or waterproof rings 56 that are provided between the wires 51 and the wire-side housing 51 and a retainer 57 retains the water-proof rings 56 in the wire-side housing 50. A shield shell 70 made of a press steel plate is to be mounted on the wire-side connector 40 and a braided wire shielding tube 71 collectively surrounds the wires 51. An end of the shielding tube 71 is fixed to the bottom end of the shield shell 70 by a crimp ring 72 and the shield shell 70 is fixed to the connector mounting plate 60 by unillustrated bolts.

A device-side housing 20 of the device connector 10 is united with three busbars 21 by insert molding. The busbars 21 are arranged substantially side by side while being inserted through a mount hole 101 of the case 100.

A substantially elliptical work hole 22 is formed in the lateral surface of the device-side housing 20. Three harness-side terminal mounts 23 are formed substantially side by side in the work hole 22 and nuts 24 are held on the respective harness-side terminal mounts 23 so that their axes extend substantially in a horizontal direction. Parts of the respective busbars 21 corresponding to the harness-side terminal mounts 23 are bent in U-shape and end portions thereof are arranged substantially along end surfaces of the nuts 24 while extending down. The harness-side terminal mounts 23 have bolt insertion holes 25 formed coaxially with threaded holes of the nuts 24.

Figure 1:
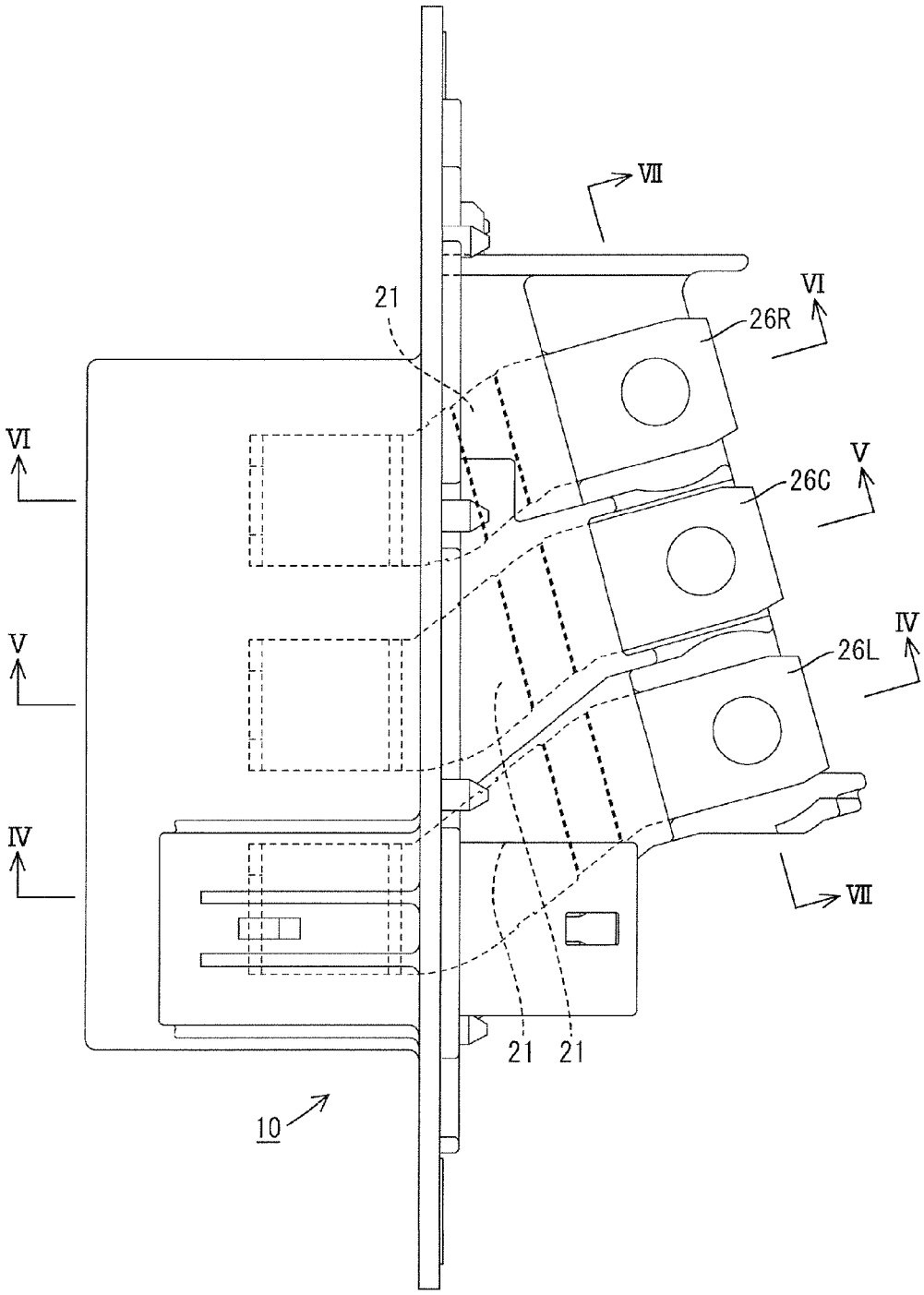
FIG. 1 is a plan view of a device connector of the invention.
Figure 2:
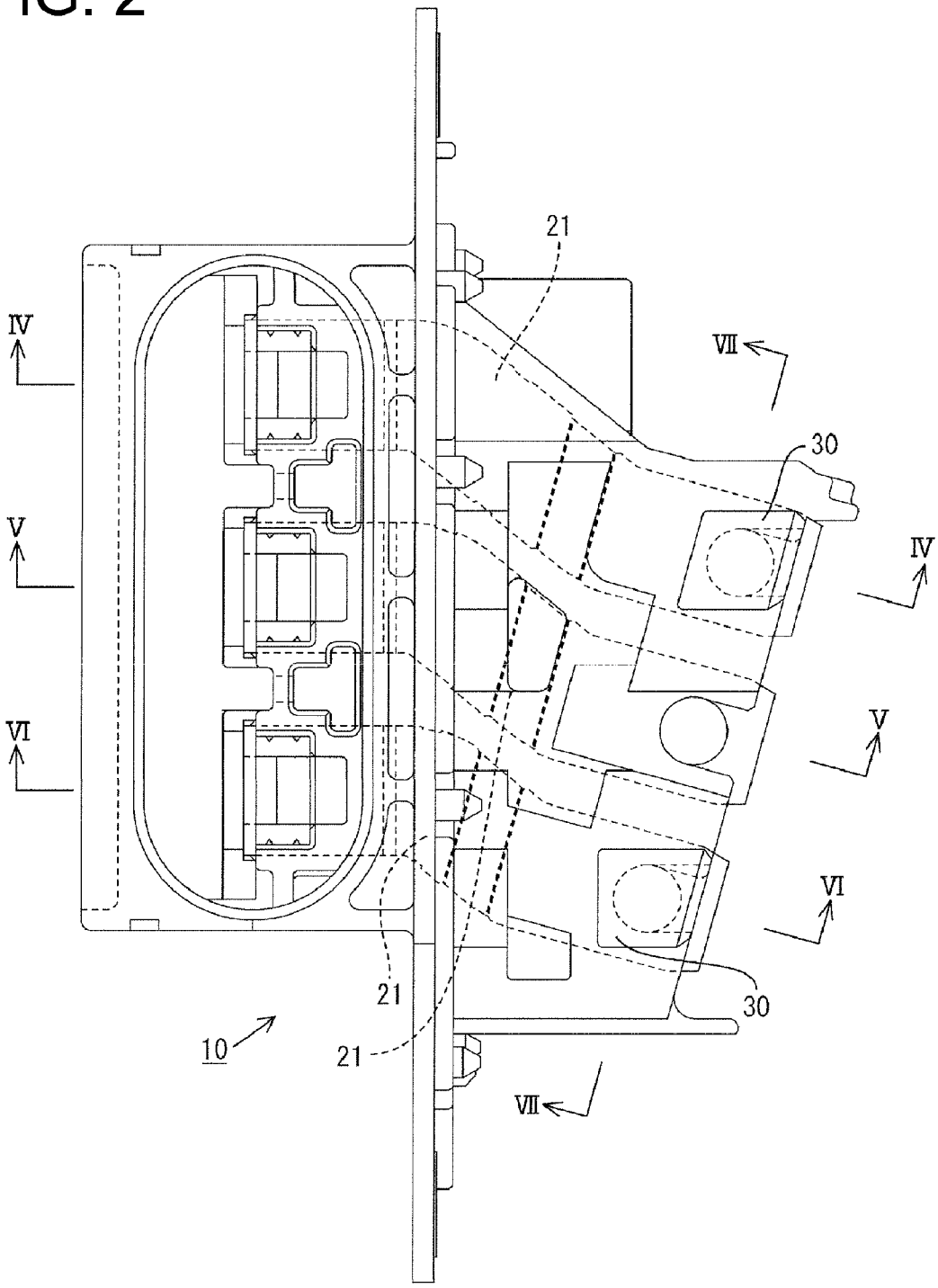
FIG. 2 is a bottom view of the device connector.
Figure 3:
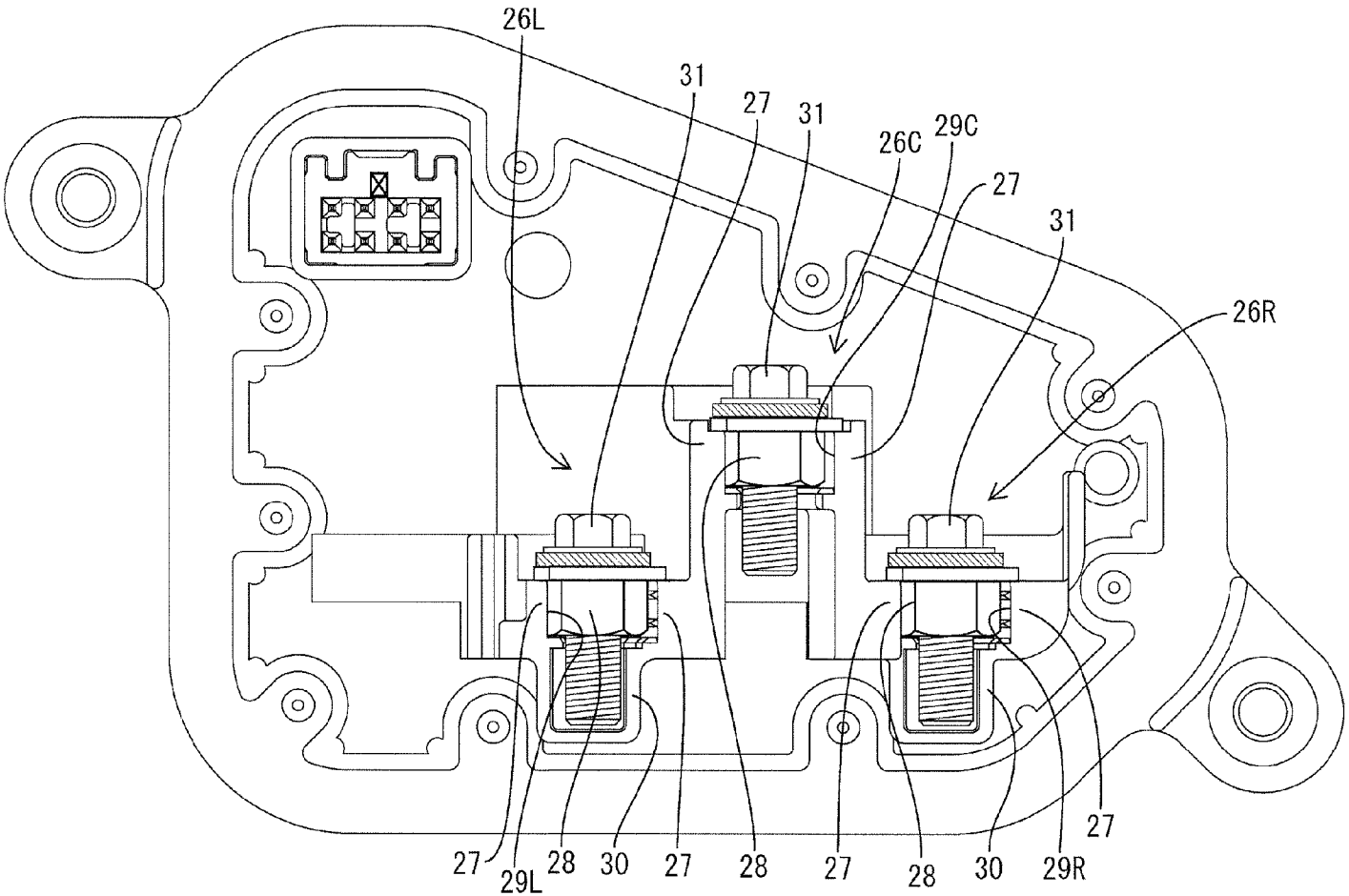
FIG. 3 is a right side view of the device connector.
Figure 7:
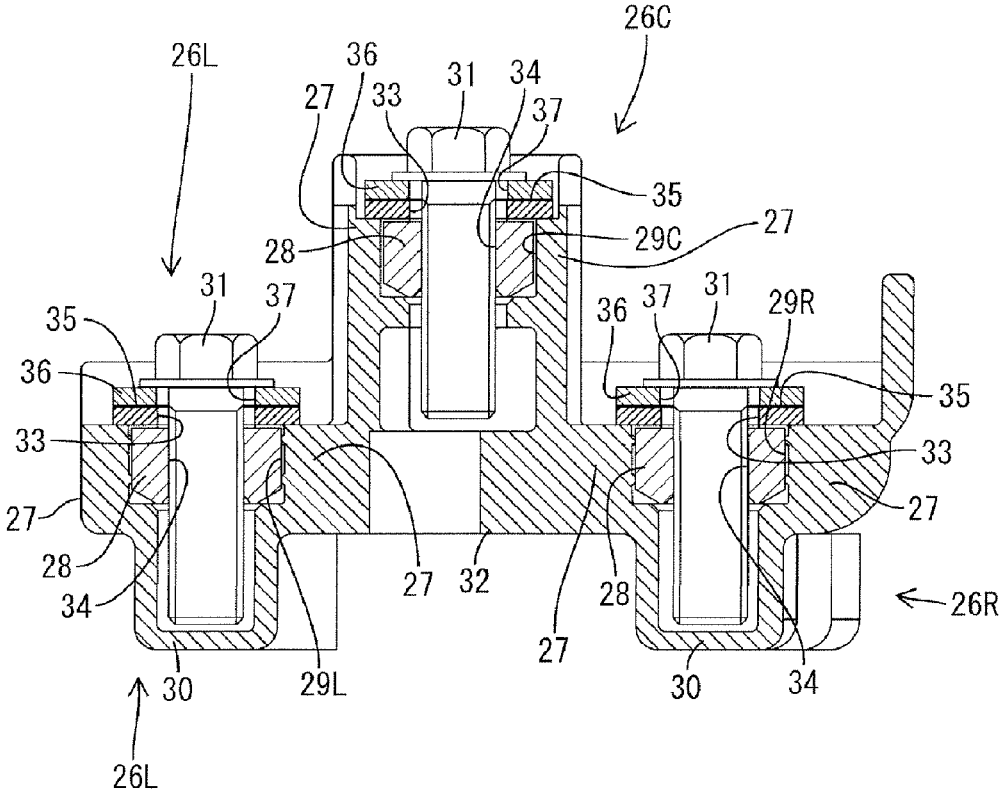
FIG. 7 is a vertical section along VII-VII of FIG. 1.

Three device-side terminal mounts 26R, 26C and 26L are formed substantially side by side on the right surface of the device-side housing 20 at a substantially opposite to the harness-side terminal mounts 23 (see FIG. 3). As shown in FIG. 7, the device-side terminal mounts 26R, 26L at the right and left sides are at substantially the same level and the central device-side terminal mount 26C is at a considerably higher level in a direction perpendicular to the plate surfaces of the busbars 21. Each terminal mount includes left and right nut holding legs 27.

Facing surfaces of the respective nut holding legs 27 are stepped and spaces therebetween open laterally toward the front with respect to the plane of FIG. 7 to form nut holding portions 29R, 29C and 29L for holding nuts 28. The hexagonal nuts 28 are fit into the nut holding portions 29R, 29C and 29L from above and are held from the opposite sides by the corresponding nut holding legs 27 and supported by the stepped surfaces.

The nut holding portions 29R, 29L at the opposite ends in an arrangement direction are formed with protecting walls 30 integral or unitary to the device-side housing 20. Each protecting wall 30 is in the form of a box connecting the nut holding legs 27 at a lower side and exposing leading ends (front ends with respect to the plane of FIG. 7) of the nut holding legs 27.

A vertical dimension of the protecting wall 30 exceeds a downward projecting distance of the bolt 31 that has been screwed into the nut 28 so that the bottom end of the connecting bolt 31 screwed into the nut 28 does not interfere with the inner bottom surface of the protecting wall 30.

The central nut holding portion 29C is constructed so that the adjacent nut holding legs 27 of the left and right nut holding portions 29L, 29R are coupled by a substantially horizontal coupling wall 32 and two nut holding legs 27 stand up from the upper surface of the coupling wall 32.

The nut holding legs 27 have stepped facing surfaces similar to the nut holding legs 27 of the left and right nut holding portions 29L, 29R and a space therebetween is open laterally (toward the front side with respect to the plane of FIG. 7). The connecting nut 28 is held between these nut holding legs 27.

The busbars 21 have device connecting portions 35 formed on the device-side terminal mounts 26R, 26C and 26L. Nut insertion holes 33 are formed in the device connecting portions 35 and communicate with the threaded holes 34 of the connecting nuts 28.

Assembly begins by placing the device-side terminals 36 on the device-side connecting portion 35. The nut insertion hole 33 and the device terminal hole 37 are aligned and the connecting bolt 31 is inserted through a device terminal hole 37, the nut insertion hole 33 and the threaded hole 34 while being screwed into the threaded hole 34.

Turning the bolt 31 generates a force on the nut 28 to turn the nut 28 together with the bolt 31. However, the nut holding legs 27 contact outer side surfaces of the nut 28 to prevent the nut 28 from turning. The device-side terminal 36 and the device connecting portion 35 are fixed by tightening the bolt 31 with a specified torque.

The nut 28 exerts a large stress acts on the nut holding legs 27 if the bolt 31 is turned with a large torque. However, the protecting wall 30 connects the nut holding legs 27. Thus, even if a stress acting on the nut holding legs 27 increases, there is no likelihood that the spacing between the nut holding legs 27 is forcibly widened and, consequently, the nut holding legs 27 will not break.

The protecting walls 30 are formed below the device-side terminal mounts 26L, 26R at the opposite left and right sides to connect the nut holding legs 27 at the lower side. Thus, the nuts 28 and the leading ends of the bolts 31 are at least partly surrounded by the protecting walls 30. Therefore, a long creepage distance can be ensured between the adjacent bolts 31 and an insulating property is improved.

The plate surfaces of the adjacent busbars 21 are at different heights. Thus, a longer creepage distance is ensured between the bolts 31 as compared with the case where the busbars 21 are arranged side by side at the same height. The protecting wall 30 is formed to expose the leading ends of the nut holding legs 27. Thus, a tightening operation can be performed while checking a tightening degree upon screwing the bolt 31 into the nut 28 and accordingly a terminal connecting operation can be performed reliably.

The invention is not limited to the above described and illustrated embodiment. For example, the following embodiments are also included in the technical scope of the present invention.

Although the central busbars is arranged at a higher position in the above embodiment, the invention is not limited to such an embodiment. According to the invention, it is possible to, for example, arrange the central busbar 21 at a lower position or arrange all the three busbars 21 at the substantially same height.

Although the protecting wall 30 is box-shaped in the above embodiment, the invention is not limited to such an embodiment and the protecting wall 30 may be merely so shaped as to connect the nut holding legs 27.

What is claimed is:

1. A device connector, comprising:

a housing unitarily formed of an insulating resin and having at least three nut holding portions disposed substantially side by side, each of the nut holding portions including two spaced apart nut holding legs, protecting boxes disposed at least at the nut holding portions at opposite ends in an arrangement direction of the nut holding portions, each of the protecting boxes being formed integrally to the housing and including at least two side protecting walls extending from the nut holding legs of the respective nut holding portion and a connecting wall extending between the side protecting walls, each of the side protecting walls being configured to expose leading ends of the nut holding legs;

a plurality of busbars, each of the busbars having an intermediate section mounted in the housing and a device connecting portion extending into a space between the nut holding legs of the respective nut holding portions, each of the device connecting portions including a nut insertion hole; and nuts sandwiched respectively between the nut holding legs of the respective nut holding portions and substantially adjacent the device connecting portions, sides of the nuts being visible between the leading ends of the nut holding legs, each of the nuts having a threaded hole communicating respectively with the nut insertion holes of the device connecting portions, at least one of the nuts being disposed between the respective device connecting portion and the connecting wall of the protecting box.

2. The device connector of claim 1, further comprising a plurality of bolts threaded into the respective nuts, each of the bolts having a head on a side of the respective device connecting portion opposite the nut and a leading end extending axially from the head, the side protecting walls at least partly surrounding sides of the leading end of at least one of the bolts and the connecting wall facing an axial end of the bolt opposite the head.

3. The device connector of claim 1, wherein the nut holding portions are arranged at different heights in a direction perpendicular to plate surfaces of the busbars for each pair of adjacent busbars.

4. A device connector, comprising:

a housing to be mounted on a device, the housing including a plurality of nut holding portions each including two opposed nut holding legs;

nuts sandwiched between the nut holding legs of the respective nut holding portions, each of the nuts having a threaded hole;

a plurality of busbars in the housing, each of the busbars including a device connecting portion to be connected with the device, each of the device connecting portions including a nut insertion hole, the device connecting portions extending into the respective nut holding portions and disposed on the respective nut so that the nut insertion holes of the device connecting portion align with the threaded hole of the respective nut; and at least one protecting box formed integrally to the housing and having two side protecting walls extending from the respective nut holding legs of the respective nut holding portions in a direction away from the device connecting portion and a connecting wall extending between the side protecting walls of the protecting box, each of the protecting boxes being configured to at least partly cover opposite sides and a leading axial end of a bolt screwed into the respective nut, the protecting box being configured to expose leading ends of the nut holding legs so that a side of the respective nut is visible.

5. The device connector of claim 4, wherein the nut holding legs of each of the nut holding portions are formed at positions on the housing facing the device connecting portion of the corresponding busbar and a laterally open space being formed between the nut holding legs of each of the nut holding portions.

6. The device connector of claim 4, wherein the nut holding portions comprise at least three nut holding portions disposed substantially side by side, and the at least one protecting box comprises at least two protecting boxes disposed at the nut holding portions at opposite ends in an arrangement direction of the nut holding portions.

7. The device connector of claim 4, wherein the nut holding portions are arranged at different heights in a direction perpendicular to plate surfaces of the busbars for each pair of adjacent busbars.

8. The device connector of claim 4, wherein plate surfaces of adjacent busbars that are adjacent to one another are located at different heights.

9. The device connector of claim 4, wherein a dimension of each of the protecting walls is larger than a projecting distance of the bolt screwed into the nut from the nut, so that a distal end of the bolt screwed into the nut does not interfere with the connecting wall of the protecting box.

10. The device connector of claim 4, wherein the housing is molded from resin, each of the busbars being insert molded into the housing so that a portion of each of the busbars is surrounded by a unitary matrix of the resin.

11. The device connector of claim 4, further comprising a plurality of bolts threaded into the respective nuts, each of the bolts having a head on a side of the respective device connecting portion opposite the nut and a leading end extending axially from the head, the side protecting walls at least partly surrounding sides of the leading end of at least one of the bolts and the connecting wall facing an axial end of the bolt opposite the head.

* * * * *